US008403284B2

(12) United States Patent
Korbonski

(10) Patent No.: US 8,403,284 B2
(45) Date of Patent: Mar. 26, 2013

(54) PALLET ASSEMBLY

(76) Inventor: Jon Korbonski, Laguna Niguel, CA (US)

( * ) Notice: Subject to any disclaimer, the term of this patent is extended or adjusted under 35 U.S.C. 154(b) by 1152 days.

(21) Appl. No.: 12/163,964

(22) Filed: Jun. 27, 2008

(65) Prior Publication Data

US 2009/0320722 A1 Dec. 31, 2009

(51) Int. Cl.
*A47B 91/00* (2006.01)

(52) U.S. Cl. ..... 248/346.02; 248/688

(58) Field of Classification Search ..... 248/346.02, 248/346.01, 688; 108/51.11, 53.1, 56.1, 108/56.3, 901, 53.5
See application file for complete search history.

(56) References Cited

U.S. PATENT DOCUMENTS 2,705,120 A * 3/1955 Owen ..... 108/57.33
3,327,654 A 6/1967 William at al.
3,799,382 A * 3/1974 Munroe ..... 217/12 R
4,000,704 A 1/1977 Griffin, Jr.
4,413,737 A 11/1983 Wind
RE32,344 E 2/1987 Wind
4,673,092 A 6/1987 Lamson et al.
4,703,702 A * 11/1987 Speicher ..... 108/56.3
4,907,515 A 3/1990 Win
5,007,352 A 4/1991 Calkoen
5,036,976 A * 8/1991 Sechler et al. ..... 206/386
5,094,175 A * 3/1992 Christie ..... 108/56.1
5,461,988 A * 10/1995 Cummings et al. ..... 108/51.3
5,483,899 A * 1/1996 Christie ..... 108/56.3
5,562,047 A * 10/1996 Forney et al. ..... 108/57.13
D388,931 S 1/1998 Constantino et al.
5,860,369 A 1/1999 John et al.
5,911,179 A 6/1999 Spiczka
5,918,551 A * 7/1999 Liu ..... 108/55.1
5,967,056 A * 10/1999 Plante ..... 108/56.1
5,996,510 A 12/1999 Harpman et al.
6,112,672 A 9/2000 Heil
6,173,657 B1 * 1/2001 Espejo ..... 108/51.11
6,199,487 B1 3/2001 Ceddington
6,273,006 B1 8/2001 Reutter
6,343,555 B1 * 2/2002 Arai et al. ..... 108/53.5
6,418,861 B1 * 7/2002 Flam ..... 108/56.1
6,463,863 B1 * 10/2002 Ishikawa et al. ..... 108/53.1
6,622,642 B2 * 9/2003 Ohanesian ..... 108/57.25
6,857,377 B2 2/2005 Herring et al.
6,938,557 B1 9/2005 Grigsby, Jr.
6,971,518 B1 12/2005 Lowry
7,066,342 B2 6/2006 Baechle et al.
7,322,299 B2 * 1/2008 Greene ..... 108/56.1
7,739,962 B2 * 6/2010 Zhu et al. ..... 108/28
7,845,113 B2 * 12/2010 Casimaty et al. ..... 47/65.9
7,908,979 B2 * 3/2011 Yoshida et al. ..... 108/57.25
7,913,629 B2 * 3/2011 Gordon ..... 108/51.3
7,958,669 B2 * 6/2011 Casimaty et al. ..... 47/1.01 F
7,959,059 B2 * 6/2011 Tamamori et al. ..... 228/212
(Continued)

*Primary Examiner* — Ramon Ramirez
(74) *Attorney, Agent, or Firm* — The Eclipse Group LLP

(57) ABSTRACT

A pallet assembly and a method for disassembling a pallet assembly into smaller, easy-to-store pieces. In one example implementation, a pallet assembly may be disassembled and re-assembled as equipment having an alternative function. In an example implementation, a pallet assembly having a pallet support structure formed by beam members connected to transverse members and a plurality of pallet surface components attached to intersecting areas of the transverse members and the beam members is disassembled by detaching the pallet surface components from the intersecting areas. The extension members may be attached to conversion enabling structure on the pallet surface components to assemble a selected piece of equipment. The pieces of equipment may be any type of equipment including furniture (tables, chairs, shelving units, bar stools, etc.).

26 Claims, 15 Drawing Sheets

U.S. PATENT DOCUMENTS

2002/0078863 A1 6/2002 Marr et al.
2002/0139798 A1 10/2002 Beall
2003/0005862 A1 1/2003 Halavais
2003/0189153 A1* 10/2003 Nakabayashi et al. ... 248/346.02
2003/0209172 A1 11/2003 Brennan et al.
2004/0107879 A1 6/2004 Schultz
2004/0226157 A1 11/2004 Isle
2004/0251154 A1 12/2004 Kulbeth et al.
2005/0001129 A1* 1/2005 Decroix ..... 248/346.02
2005/0023168 A1 2/2005 Marnocha
2005/0029141 A1 2/2005 Cornelius et al.
2005/0036847 A1 2/2005 Brackmann et al.
2005/0081763 A1 4/2005 von Holle
2005/0120921 A1 6/2005 Baechle
2007/0227406 A1 10/2007 Korbonski
2008/0295748 A1* 12/2008 Yoshida et al. ..... 108/55.1

* cited by examiner

SECTION C-C
SCALE .187

SECTION A-A
SCALE .187

PALLET ASSEMBLY

FIELD OF THE INVENTION

This invention relates generally to pallets, and more particularly, to convertible pallets that may be disassembled.

BACKGROUND OF THE INVENTION

Many companies throughout the world participate in trade shows. Many of these entities utilize specially built furniture to support their displays in the trade shows. The movement of displays and furniture and other large objects is typically facilitated at such trade shows by the use of pallets, which are platforms or supporting structures used to hold and move large, heavy and bulky objects. Pallets typically have a somewhat standard structure that allows a fork-lift, or other heavy machinery to lift and move loaded or unloaded pallets from one place to another. Of course, the use of pallets is not restricted to trade shows. Pallets may be used to hold and move large, heavy and bulky objects in any environment.

One of the most difficult and expensive aspects of participating in trade shows is the assembly, disassembly, and movement of the display and furniture. In addition, once the display is setup, the pallets are stored for use until it is time to disassemble the display. Often times, the company representatives must wait several hours for the return of these pallets before they can repack their display booths. The need to store the pallets may therefore add significant problems and costs to the process of setting up for a trade show. In addition, the rental of furniture for an exhibiting company represents a very high cost.

While there have been a number of pallet designs and related devices, there is a need for a system in which a pallet may be easily disassembled for easy storage. There is also a need for systems that may be easily disassembled and reassembled as equipment having alternative functions.

SUMMARY OF THE INVENTION

In view of the above, a method is provided for converting a pallet to alternative use equipment. In an example implementation of the method, a pallet assembly having a pallet support structure formed by beam members attached to transverse members and a plurality of pallet surface components attached to intersecting areas formed at the areas of attachment of the transverse members and the beam members. The pallet assembly may be disassembled by detaching the pallet surface components from the intersecting areas, and by detaching the beam members from the transverse members.

In another aspect of the method, the extension members may be attached to conversion enabling structure on the pallet surface components to assemble a selected piece of equipment.

In another aspect of the invention, a pallet assembly is provided configured to be disassembled as pieces that are easier to store than entire pallet assemblies. One example pallet assembly includes a plurality of beam members. A plurality of transverse members are configured to connect to the beam members. A pallet support structure is formed by having at least two of the transverse members connected to the sides of at least one pair of beam members. The pallet support structure is formed so as to define areas of intersection where the transverse members and beam members attach. A plurality of pallet surface components are configured to fit over the areas of intersection on the pallet support structure to form a substantially flat surface and, with the pallet support structure, to function as a pallet.

In another aspect of the invention, the pallet surface components may include a conversion enabling structure to receive selected components that convert at least the pallet surface components to pieces of equipment that do not function as pallets when detached from the pallet support structure.

Other devices, apparatus, systems, methods, features and advantages of the examples consistent with the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

Examples of systems and methods consistent with the present invention are described below with reference to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
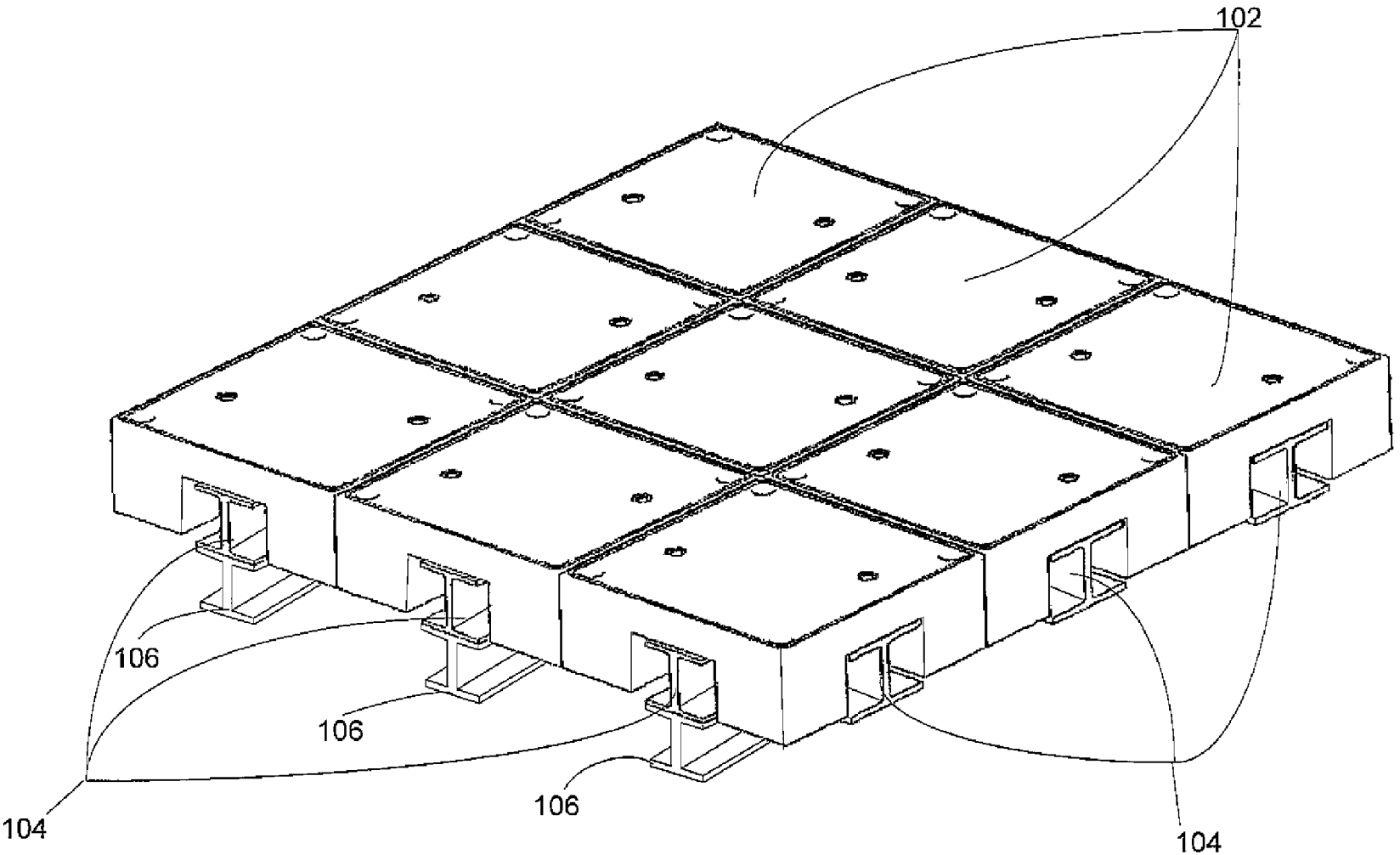
FIG. 1 is a top perspective view of an example pallet assembly.

FIG. 1 is a top perspective view of an example pallet assembly 100. The pallet assembly 100 may be disassembled to components that may be re-assembled as other pieces of equipment. Disassembly of the pallet assembly may mean disassembly into various completely disassembled parts or into components that include a collapsed structure. The pallet assembly 100 includes a plurality of pallet surface components 102 and a plurality of pallet support structure components 104. The pallet surface components 102 may be formed to fit over a pallet support structure formed by the pallet support structure components 104. The pallet assembly 100 in FIG. 1 may be used as a typical pallet by attaching pallet lifting beams 106 to the underside of the pallet assembly 100. Large objects may be placed on the top surface 106 formed by the plurality of pallet surface components 102. The pallet assembly 100 may be supported by the pallet support structure components 104 and the pallet lifting beams 106. The pallet lifting beams 106 may be attached with sufficient space between them to fit a forklift underneath. The pallet lifting beams 106 may be attached using bolts, or any other suitable attaching mechanism. In another example, the pallet lifting beams 106 may be fixed to the pallet support structure components 104.

Figure 2:
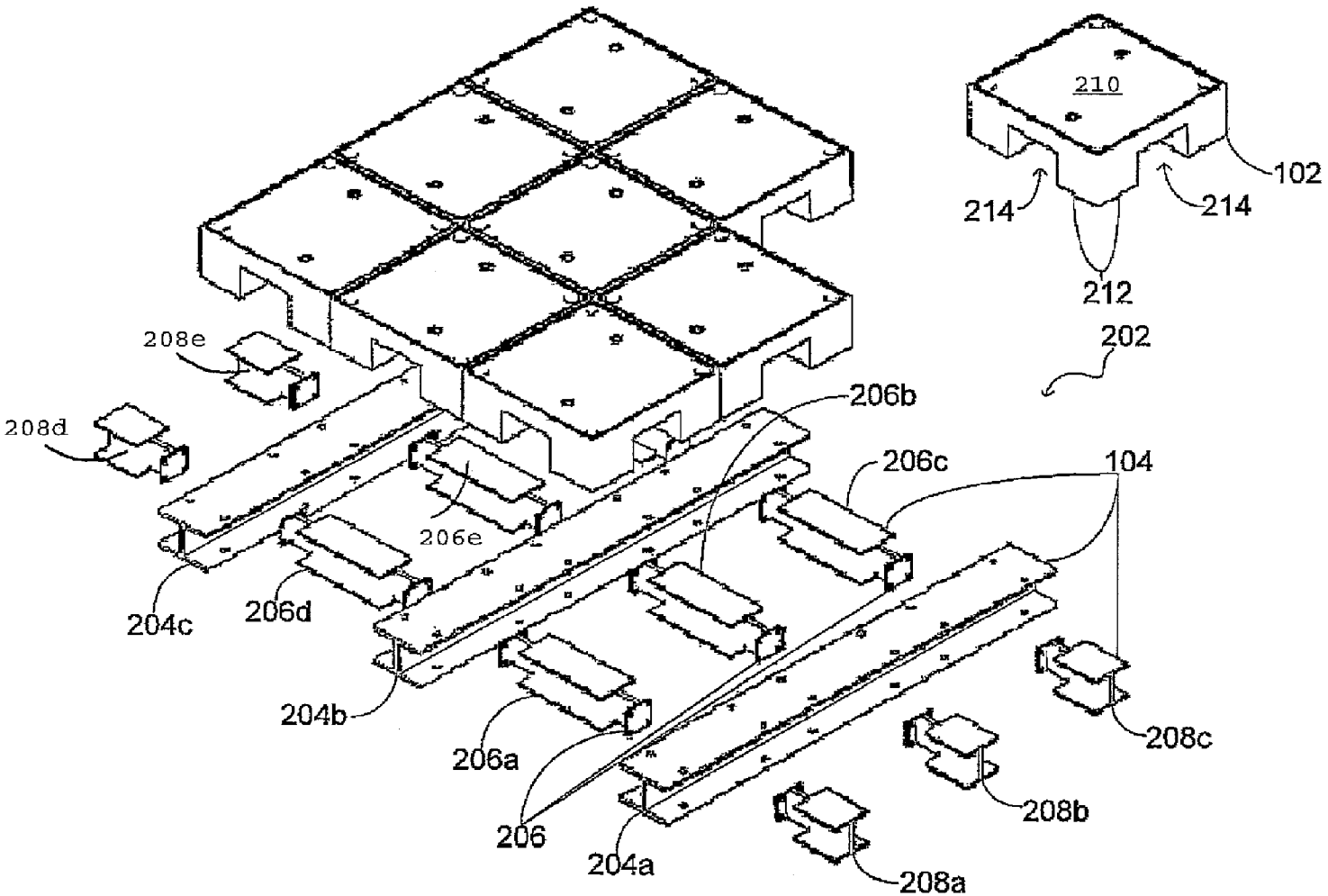
FIG. 2 is a perspective exploded view of the example pallet assembly in FIG.

FIG. 2 is a perspective exploded view of the example pallet assembly in FIG. 1. The plurality of pallet surface components 102 may lift off a pallet support structure 202 formed by the pallet support structure components 104. The pallet support structure components 104 may include a pair of beam members 204 attached to one or more transverse members 206. The transverse members 206 may be placed substantially in parallel with one another and attached at their ends to the beam members 204. The beam members 204 are "attached" to the transverse members 206 using an attachment mechanism that permits repeated detachment and re-attachment. In addition, the transverse members 206 may be attached to the beam members 204 and detached by collapsing to a structure in which the beam members 204 and transverse members 206 do not form intersecting areas. In the collapsed structure, the beam members 204 may remain in contact with the transverse members 206, but in contact via a hinge or other supporting structure that keeps the beam members 204 and transverse members 206 together in the collapsed structure.

The pallet assembly 100 in FIG. 2 includes three beam members 204*a-c*. Three transverse members 206*a-c* are attached between the first and second beam members 204*a* and 204*b*. Three additional transverse members (only two transverse members 206*d* and 206*e* are visible in FIG. 2) are attached between the second and third beam members 204*b* and 204*c*. The pallet assembly 100 in FIG. 2 also includes end members 208*a-c* extending substantially perpendicular to the first beam member 204*a*, and three end members (only two end members 208*d* and 208*e* are visible in FIG. 2) extending substantially perpendicular to the third beam member 204*c*. The end members 208*a-c* are connected to the first beam member 204*a* substantially at the points of attachment of the three transverse members 206*a-c*. The end members 208*d-f* are connected to the third beam member 204*c* substantially at the points of attachment of transverse members 206*d*, 206*e*, and the transverse member that is not visible in FIG. 2.

The beam members 204 and transverse members 206 when assembled form a lattice-like structure having areas of intersection between the beam members 204 and the transverse members 206. The pallet surface components 102 are formed to fit on and cover the points of intersection. The pallet surface components 102 may have a planar, rectangular top surface 210. The pallet surface components 102 shown in FIG. 2 have a square planar top surface 210. The top surface 210 includes a side surface 212 extending downward from each edge of the top surface 210. Each side surface 212 includes an opening 214 dimensioned to receive either the beam members 204 or the transverse members 206 of the pallet support structure 104. The pallet surface component 102 may be placed over the point of intersection formed at the point where transverse members 206 opposite one of the beam members 204. Two openings 214 on opposite sides of the pallet surface component 102 fit over the beam member 204 and the other two openings 214 fit over the transverse members 206. The dimensions of the pallet surface components 102 may be such that the pallet surface components 102 come together at the top surface 210 edges to form a flat surface over the pallet support structure 104 when each point of intersection is covered by one of the pallet surface components 102.

The pallet lifting beams 106 are not shown in FIG. 2. However, the may be attached to either the underside of the beam members 204, between the beam members 204, to the underside of the transverse members 206, or between the transverse members 206. The pallet lifting beams 106 may also be fixed to the underside of the beam members 204, such that the two members for a unit.

It is to be understood by those of ordinary skill in the art that the pallet support structure 104 described with reference to FIG. 2 is but one example of a pallet support structure. Other structures may be used as well. For example, the pallet support structure 104 may be at least partially collapsible into one or more structures suitable for conversion to other pieces of equipment.

Figure 3:
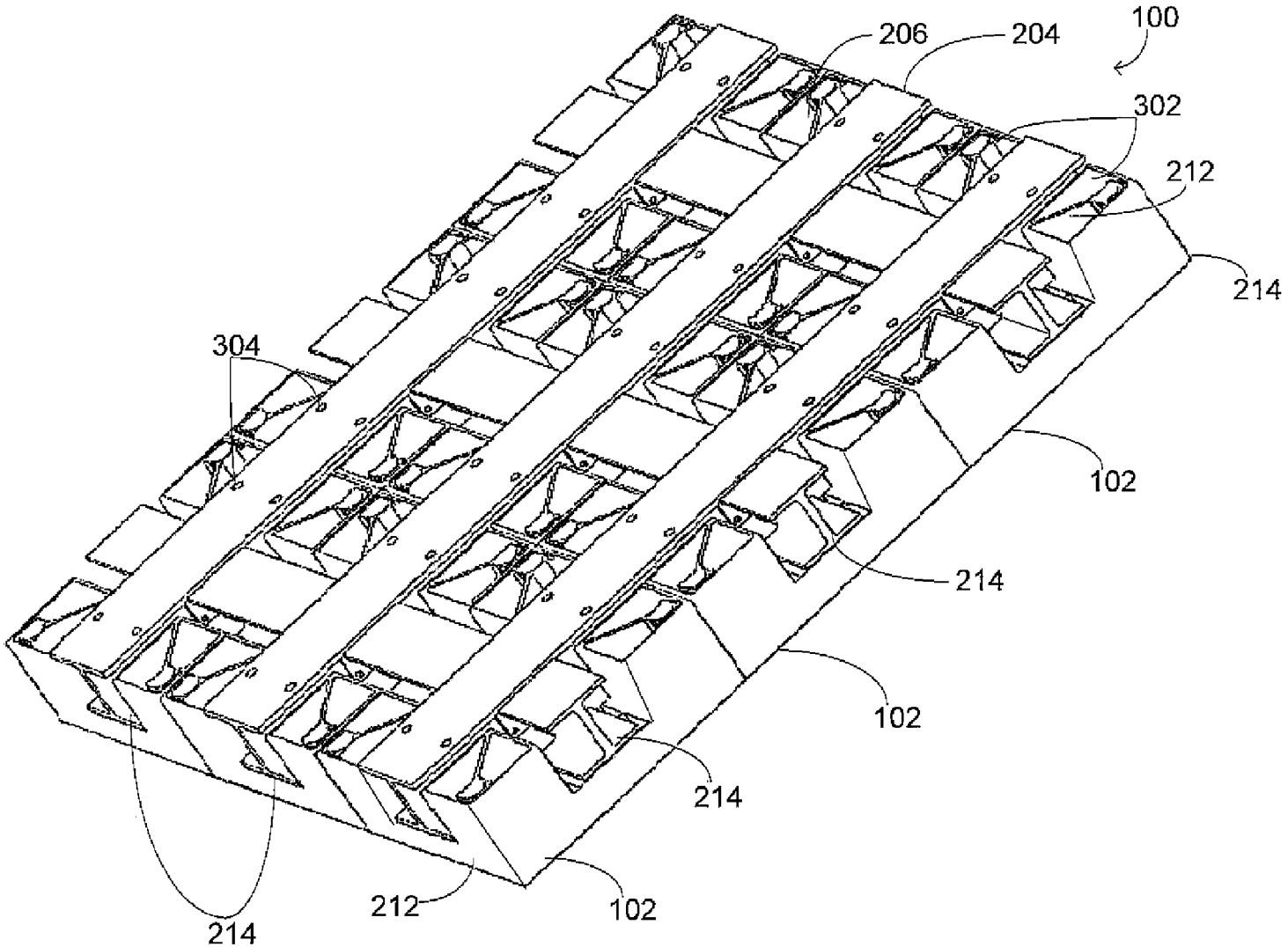
FIG. 3 is a bottom perspective view of the example pallet assembly in FIG. 1.

FIG. 3 is a bottom perspective view of the example pallet assembly 100 in FIG. 1. The pallet assembly 100 includes the pallet support structure 104, which includes the beam members 204, the transverse members 206, and end members 210 assembled as described above with reference to FIGS. 1 and 2. FIG. 3 shows the bottom view of the pallet surface components 102 depicting corner sections 302 formed by the openings 214 in the sides 212 of the pallet surface components 102. Each corner section 302 may include a conversion enabling structure 304 or other structure that may be used to insert components that permit conversion of the pallet surface components 102 to other types of equipment as described in more detail below with reference to FIGS. 7-14. The conversion enabling structure 304 may be any suitable shape consistent with the components used to make the other types of equipment. The conversion enabling structure 304 in FIG. 3 is a round hole configured to fit a rod-like structure when inserted into the conversion enabling structure 304. The conversion enabling structure 304 in FIG. 3 is but one example structure. Other shapes and mechanisms maybe used as well.

Figure 4A:
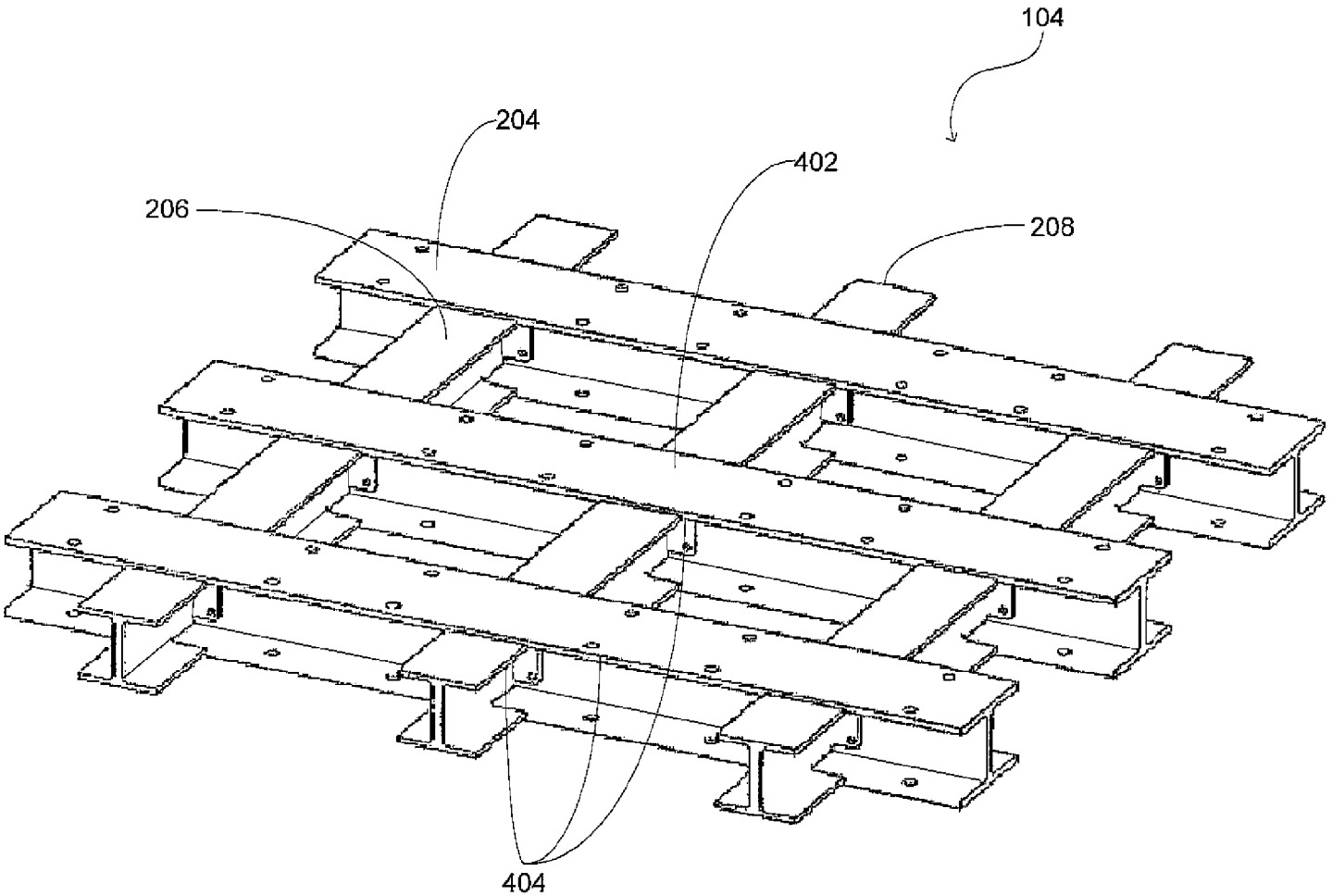
FIG. 4A is a top perspective view of an example pallet support structure of the example pallet assembly in FIG. 1.

FIG. 4A is a top perspective view of an example assembled pallet support structure 104 of the example pallet assembly 100 in FIG. 1. FIG. 4A shows the transverse members 206 and end members 208 attached to the beam members 204. The transverse members 206 and end members 208 attach to the beam members 204 at areas of intersection 402. The pallet surface components 102 may be placed over the areas of intersection 402 to form a pallet. The transverse members 206 and end members 208 may be attached to the beam members 204 using bolts, screws, or other detachable attachment devices at, for example, attachment points 404. In alternative example structures, the transverse members 206, end members 208 and/or beam members 204 may not require detachment from one another, and may be collapsible when disassembled to convert to other equipment.

The pallet support structure 104 such as the one in FIG. 4A provides the rigidity and support to function as a pallet. Those of ordinary skill in the art will appreciate that the structure 104 is but one example of a pallet supporting structure.

Figure 4D:
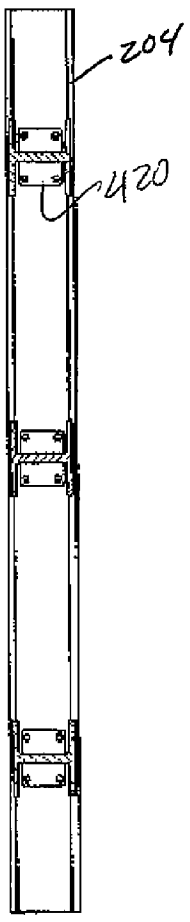
FIG. 4D is a cross-sectional view of the example pallet support structure in FIG. 4A at the cross-section defined by C-C'.
Figure 4C:
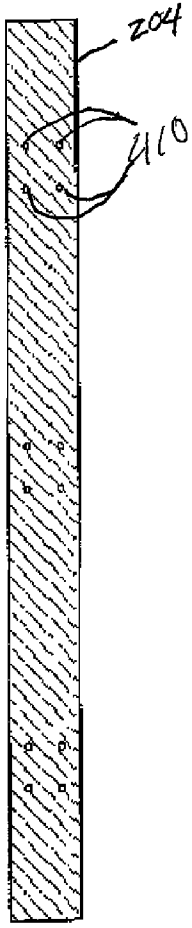
FIG. 4C is a cross-sectional view of the example pallet support structure in FIG. 4A at the cross-section defined by A-A'.
Figure 4B:
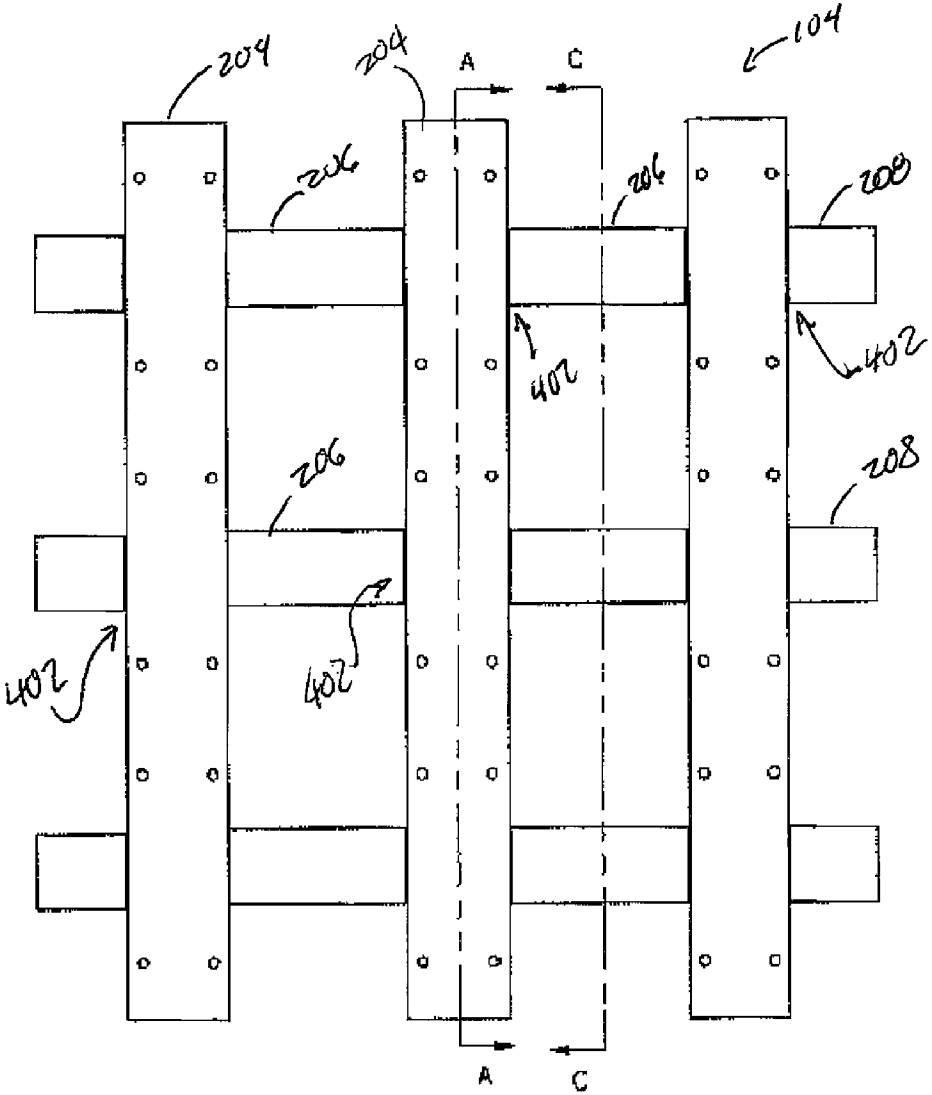
FIG. 4B is a top view of the example pallet support structure in FIG. 4A.

FIG. 4B is a top view of the example pallet support structure 104 in FIG. 4A. The beam members 204 are connected to the transverse members 206 and end members 208 to form the support and areas of intersection 402 on which the pallet surface components 102 (FIG. 1) are placed to form the pallet.

FIG. 4C is a cross-sectional view of the example pallet support structure in FIG. 4A at the cross-section defined by A-A'. FIG. 4C shows points at which transverse members are attached as four holes 410 through which detachable attachment devices are implemented.

FIG. 4D is a cross-sectional view of the example pallet support structure in FIG. 4A at the cross-section defined by C-C'. The view at the cross-section defined by C-C' shows an example of how transverse members 206 (or end members 208) may be attached to the beam members 204. As shown in FIG. 4D, the transverse members 206 include a pair of attachment flaps 420 with holes configured to align with the beam member holes 410 for implementation of the detachable attachment devices. For example, a bolt may be inserted in the holes of the attachment flaps 420 to go through the beam member holes 410 and through the attachment flaps 420 of the transverse member 204 (or end member 206) on the opposite side of the beam member 204. Those of ordinary skill in the art will appreciate that FIG. 4D shows but one example of how the transverse members 206 may be attached to the beam members 204. Attachment of the transverse members 206 to the beam members 204 may be accomplished using any suitable means.

Figure 5:
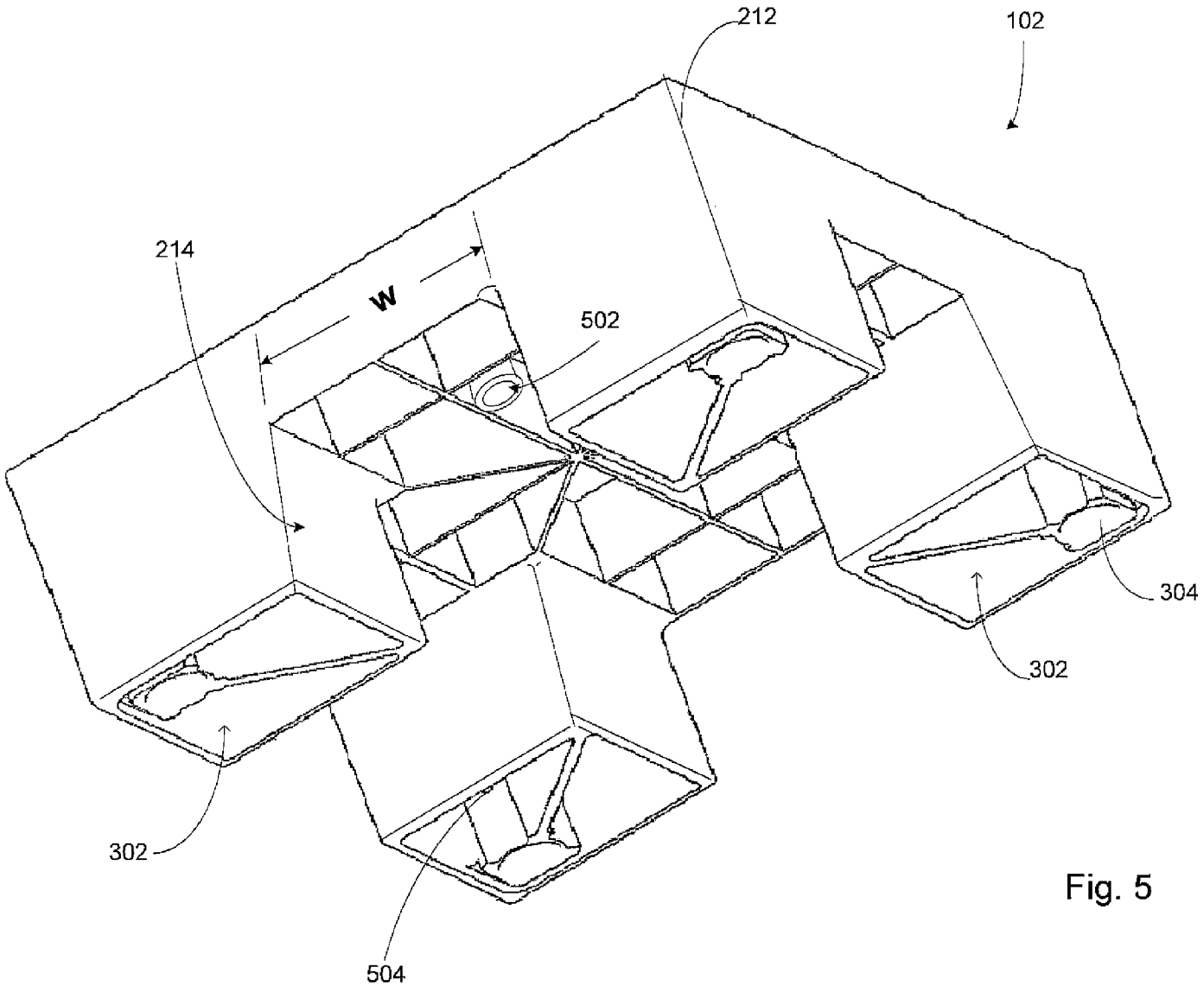
FIG. 5 is a bottom perspective view of an example pallet surface component used in the example pallet assembly in FIG. 1.

FIG. 5 is a bottom perspective view of an example pallet surface component 102 used in the example pallet assembly in FIG. 1. FIG. 1 shows the side surfaces 212 with openings 214. The openings 214 have a width w, which is selected to be sufficient for either one of the beam member 204 or the transverse member 206 to fit. The openings 214 and side surfaces 212 form corner sections 302 on the pallet surface component 102. The corner section 302 may include a conversion enabling structure 304 that may be used to receive a component that enables conversion of the pallet surface component 102 to another type of equipment.

The pallet surface component 102 includes a pallet attachment enabler 502 to enable fastening of the pallet surface component 102 to the pallet support structure 104 (FIG. 1). For example, a bolt or screw or other attaching device type may be inserted in the pallet attachment enabler 502 and received by a complementary attachment enabler in the beam member 204 or transverse member 206.

The holes 304 for receiving structure that may be used to receive a component that enables conversion of the pallet surface component 102 to another type of equipment may include a secure attachment enabler 504 to receive a mechanism for securing the component. In one example, a cotter pin may be inserted in the secure attachment enabler 504 to secure the component to the pallet surface component 102. Other implementations may be used instead.

Figure 6:
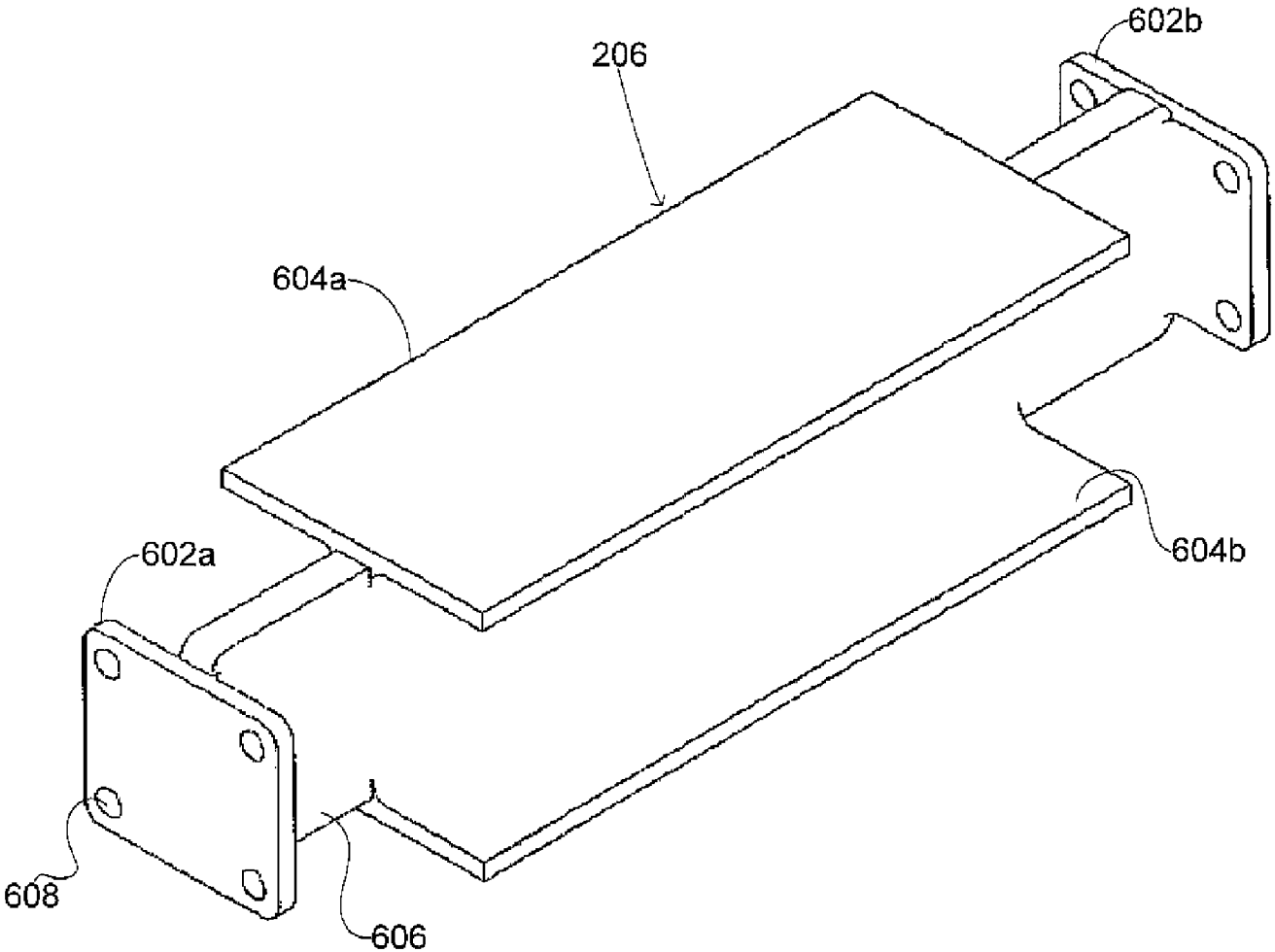
FIG. 6 is an example internal cross-member used in the example pallet support structure of the example pallet assembly in FIG. 1.

FIG. 6 is an example transverse member 206 that may be used in the example pallet support structure 104 of the example pallet assembly 100 in FIG. 1. The transverse member 206 includes a first and second attachment portions 602*a* and 602*b* on opposite ends of the transverse member 206. The attachment portions 602*a,b* are attached to opposite ends of a main transverse member 606. The main transverse member 606 in FIG. 6 is rectangular with substantially planar surfaces having a length and a width, and a thickness separating the planar surfaces. The main transverse member 606 functions to provide weight-bearing support to the pallet assembly 100 in the direction normal to the beam members 204 (FIG. 2). The main transverse member 606 provides the weight-bearing support by being mounted with the planar surfaces oriented substantially perpendicular to the pallet surface. The transverse member 206 also includes a first and second support plate 604*a,b* fixed to opposite edges of the main transverse member 606. The support plates 604*a,b* provide a surface that contacts the bottom surface of the pallet surface components 102 when assembled as a pallet.

The attachment portions 602*a,b* include one or more attachment enablers 608 to enable fastening the attachment portion 602*a* to the beam members 204. The attachment enablers 608 in FIG. 6 are holes through which bolts, screws, or other rod-like attachment devices may be inserted to fasten the transverse member 206 to the beam member 204.

The transverse member 206 may be made of metal (such as aluminum, steel, or any other suitable metal or alloy), plastics/polymers, wood, or any other suitable substantially rigid material. The transverse member 206 may be cast, or assembled by, for example, welding the attachment portions 602 and support plates 604 to the main transverse member 606.

As described above, when the pallet assembly 100 is disassembled (which may be disassembly by collapsing the pallet support structure), the pallet surface components 102 and the pallet support structure components 104 may be re-assembled as different types of equipment, such as for example, furniture. FIGS. 7-14 illustrate examples of furniture that may be assembled using pallet surface components 102 and pallet support structure components 104 used for the pallet assembly 100. In general, the pieces of equipment may be assembled by attaching vertical support extension members to the pallet surface components 102 of the pallet assembly to assemble a desired piece of equipment. FIGS. 7-14 illustrate assembling the components to convert the structure to furniture. Those of ordinary skill in the art will appreciate that any type of equipment may be similarly constructed.

Figure 7:
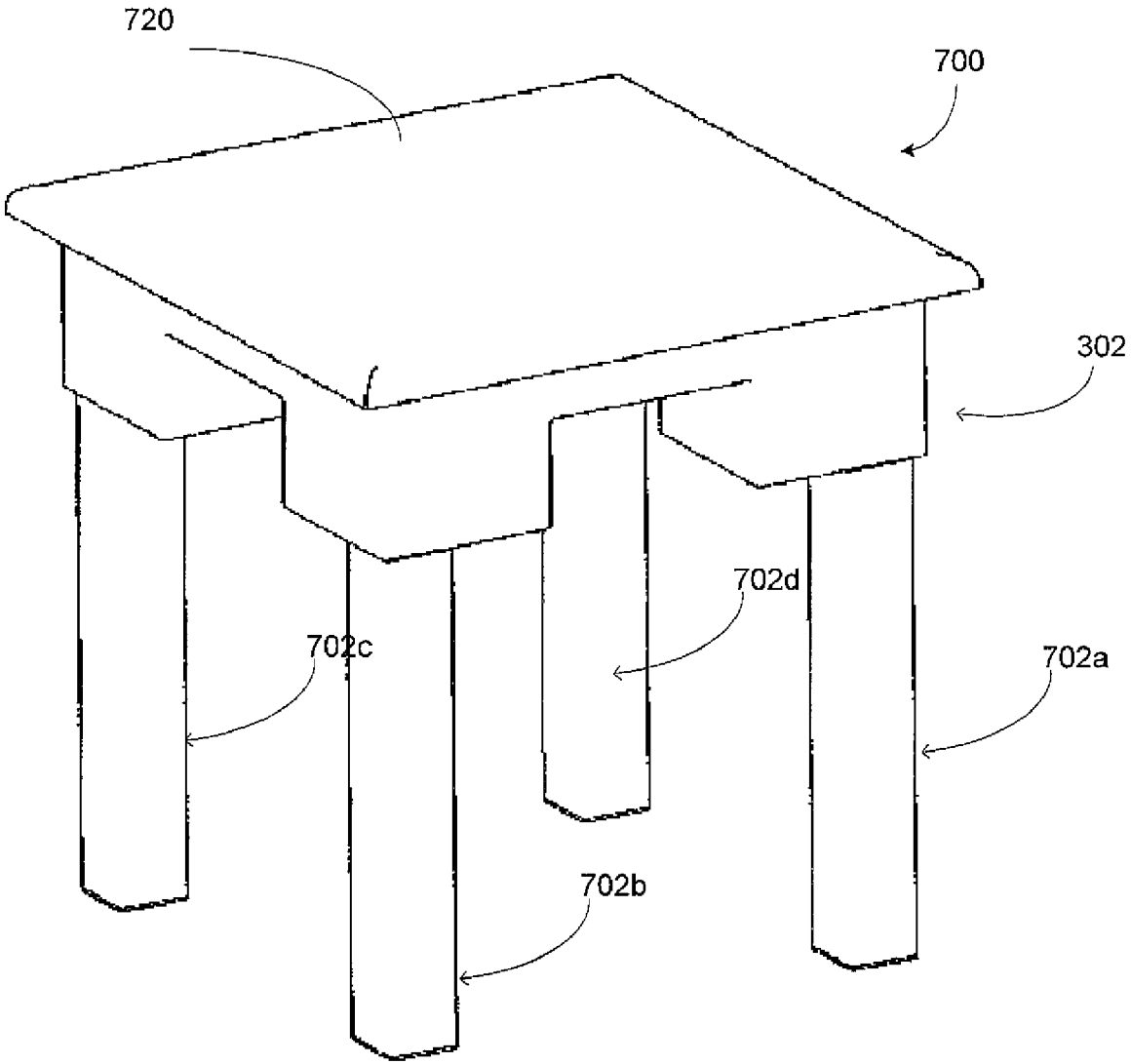
FIG. 7 is a perspective view of an example coffee table assembled with the example pallet surface component in FIG. 5.

FIG. 7 is a perspective view of an example coffee table 700 assembled with the example pallet surface component 102 in FIG. 5. The coffee table 700 includes the pallet surface component 102 and four table legs 702*a-d*, which are the vertical support extension members. The table legs 702*a-d* are attached to the pallet surface component 102 at the corner sections 302 of the pallet surface component 102.

Figure 8:
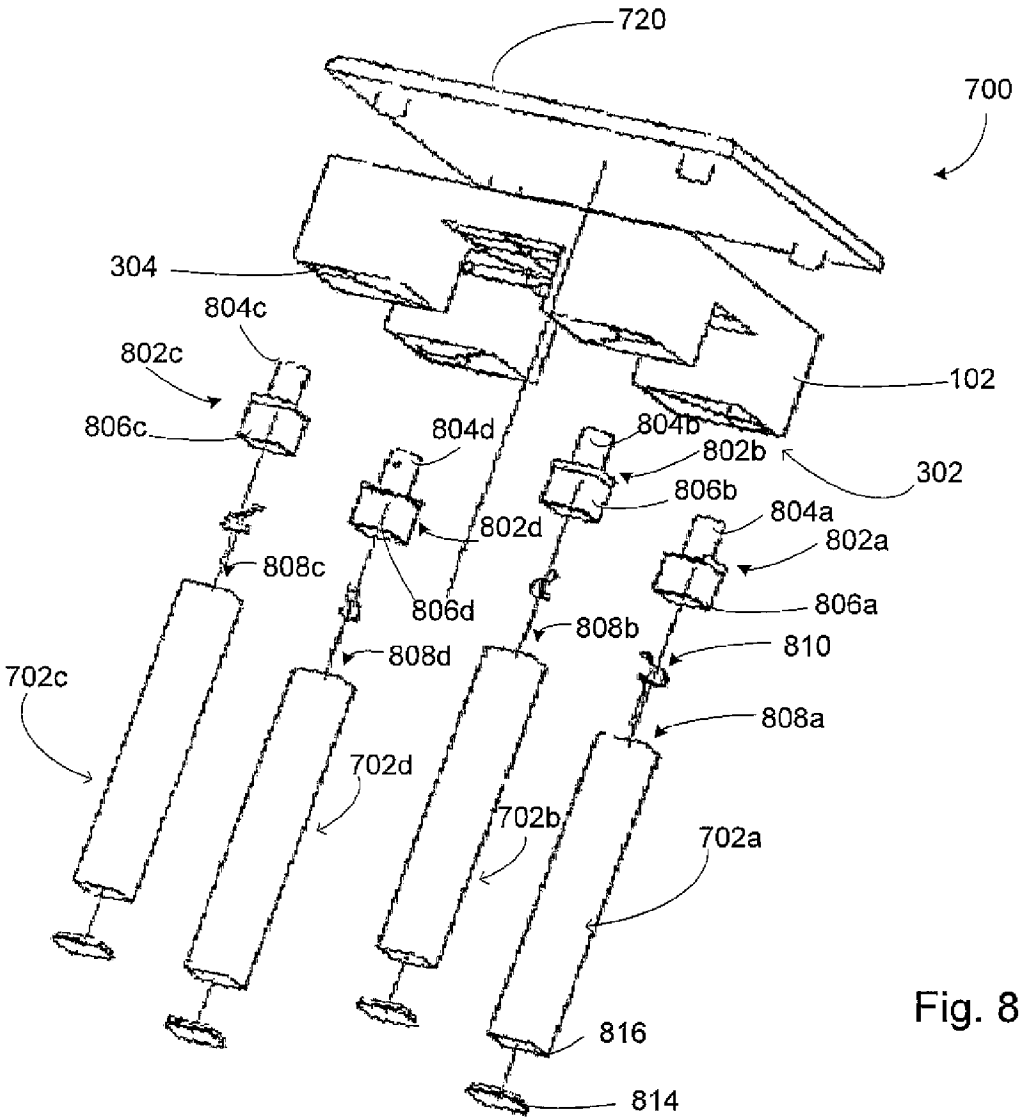
FIG. 8 is an exploded perspective view of the example coffee table in FIG. 7.

FIG. 8 is an exploded perspective view of the example coffee table 700 in FIG. 7. FIG. 8 illustrates how the coffee table 700 may be assembled using the pallet surface component 102. The coffee table 700 may be assembled by inserting extended part fasteners 802*a-d* into fastener receiving holes 304 in the corner sections 302 of the pallet surface component 102. The extended part fasteners 802*a-d* may include a cylindrical portion 804*a-d* extending from a block portion 806*a-d*. The cylindrical portion 804 may be formed to fit the fastener receiving holes 304 in the corner sections 302 of the pallet surface components 102. The block portions 806 may be dimensioned to fit inside a hollow end 808*a-d* of each table leg 702*a-d*. Each leg 702*a-d* may include a spring clip 810*a-d* attached to the surface block portions. The hollow ends 808*a-d* of the table legs 702*a-d* may include structure to allow the legs 702*a-d* to snap into the fasteners 802*a-d*. The springs 810*a-d* may be used to prevent wobble by the legs 702*a-d*.

The table 700 in FIGS. 7 and 8 may also include a seat cover 720 that maybe configured to fit into the top of the pallet surface component 102. For example, the seat cover 720 may include protrusions dimensioned to fit into corresponding holes on the pallet surface component 102. The table 700 may also include leg pads 814 that may be press fit in a hollow end 816 of the table legs 702 to provide a more slippery surface contact with the floor.

Figure 9:
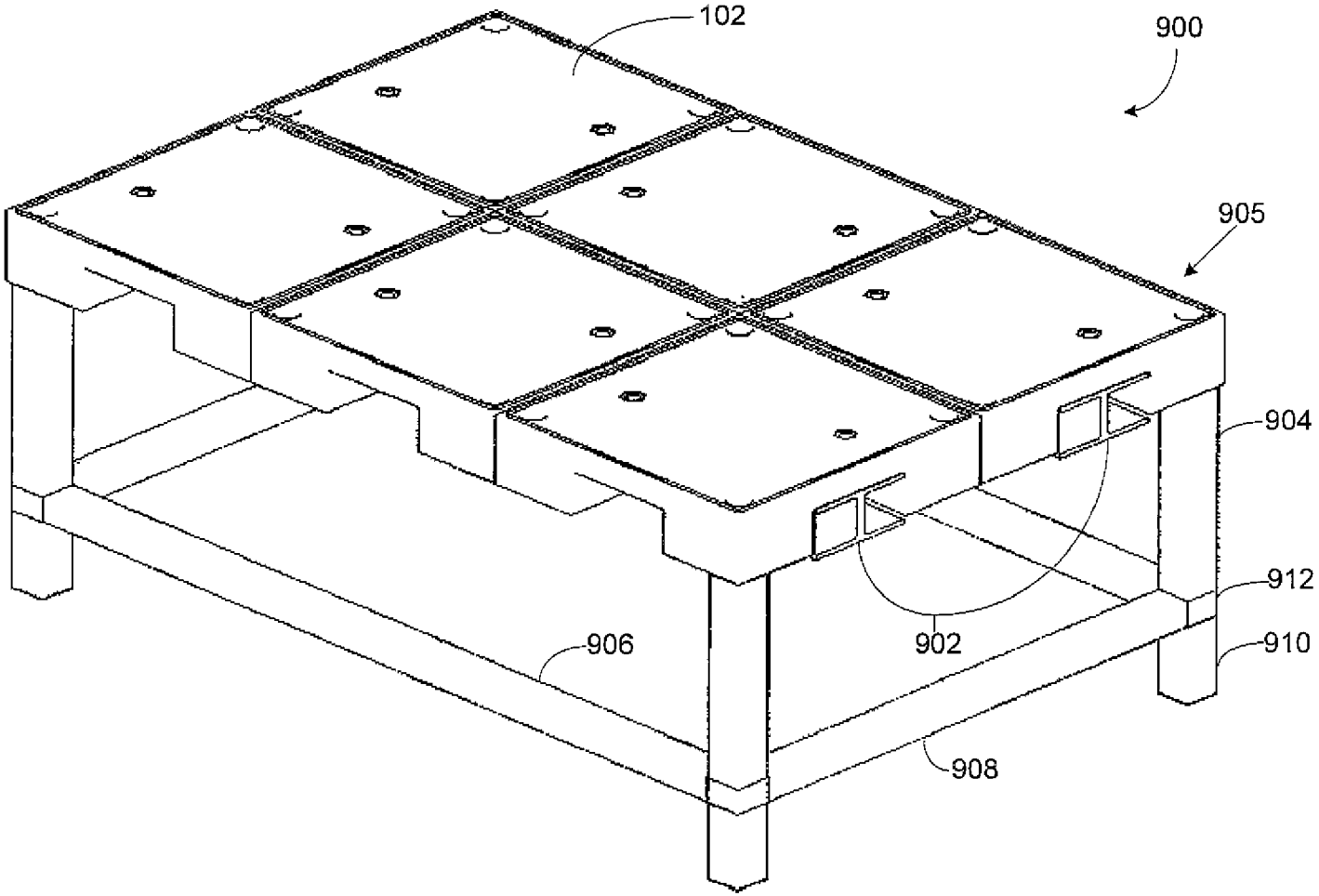
FIG. 9 is a perspective view of an example table assembled with multiple pallet surface components in FIG. 5.

FIG. 9 is a perspective view of another example table 900 assembled with multiple pallet surface components in FIG. 5. The table 900 in FIG. 9 includes six (6) pallet surface components 102 mounted on a partial pallet support structure 902 to form a substantially flat table top 905. The table top 905 may be supported by four legs 904 extending from the corner sections 302 of the four pallet surface components 102 on the corners of the table top 905. The four legs 904 may be connected to corresponding cross-member fasteners 912, which may connect to length-wise cross-members 906 and width-wise cross-members 908 to provide the table 900 with stability. Each leg 904 may also have an end extension 910 to extend to contact the floor.

Figure 10:
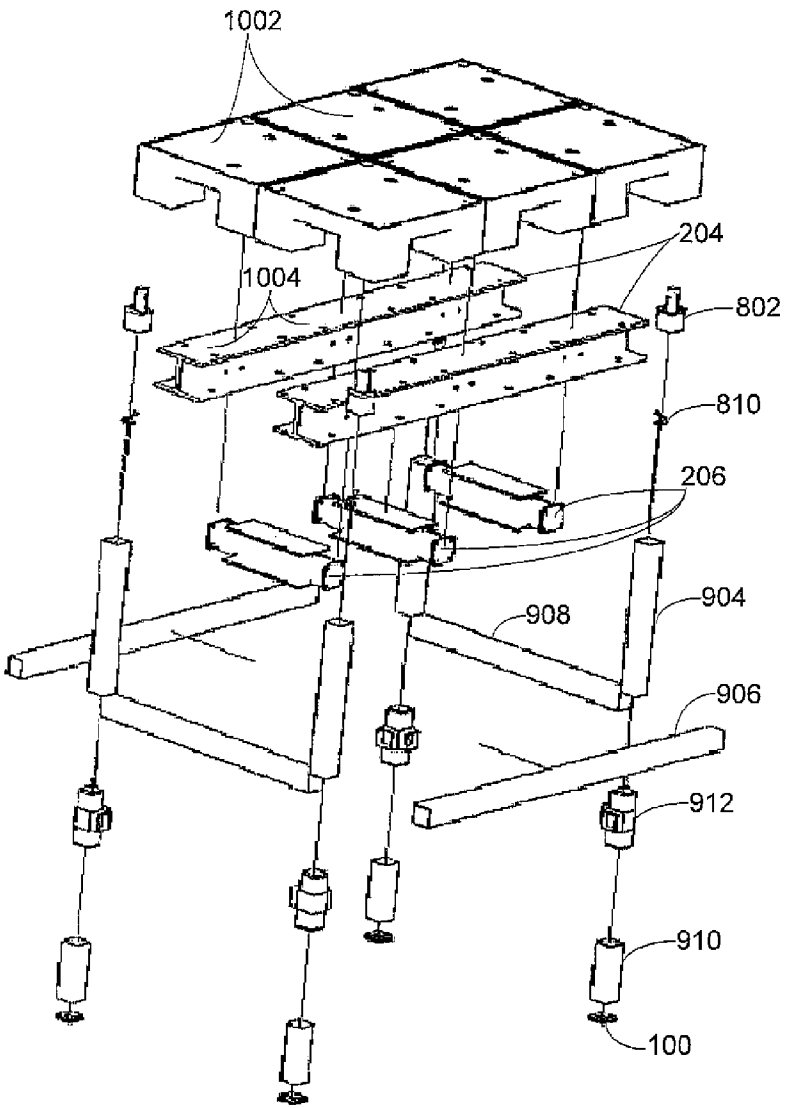
FIG. 10 is an exploded perspective view of the example table in FIG. 9.

FIG. 10 is an exploded perspective view of the example table 900 in FIG. 9. The table top 905 in FIG. 10 is formed with six (6) pallet surface components 102. The partial pallet support structure 902 includes two beam members 204 joined to three transverse members 206. The beam members 204 and transverse members 206 may be joined in a manner similar to that described above with reference to FIGS. 1-6. The pallet surface components 102 may be attached to the partial pallet support structure 902 by fastening the pallet surface components 102 to beam members 204. For example, the pallet surface components 102 may be attached by screws, bolts, or other suitable attachment devices at attachment holes 1002 in the pallet surface components 102 and corresponding attachment holes 1004 in the beam members 204. The legs 904 may be attached to the corner sections 302 of the pallet surface components 102 using the extended part fasteners 802 and spring clips 810 as described above for the coffee table 700 with reference to FIGS. 7 and 8. The legs 904 in FIG. 10 are connected to cross-member fasteners 912, which are also connected to corresponding length-wise and width-wise cross-members 906, 908. The cross-member fasteners 912 connect to leg ends 910, which may be fitted with leg pads 1006.

Figure 11:
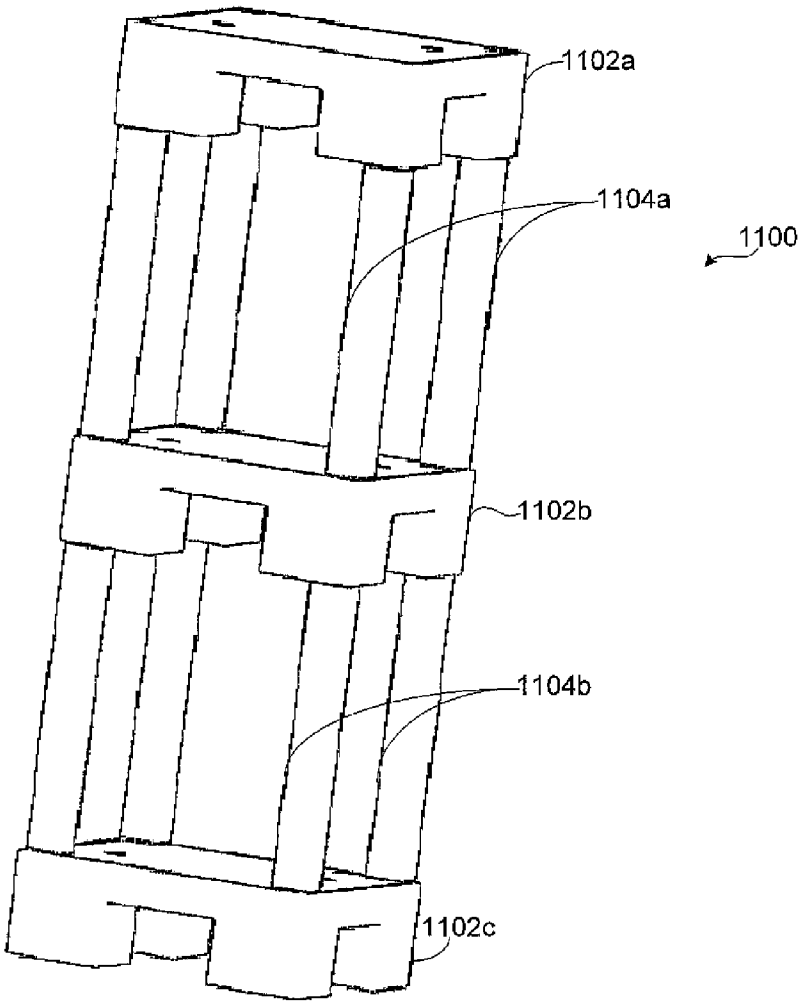
FIG. 11 is a perspective view of an example shelving unit assembled with multiple pallet surface components in FIG. 5.

FIG. 11 is a perspective view of an example shelving unit 1100 assembled with multiple pallet surface components 102 in FIG. 5. The shelving unit 1100 in FIG. 11 includes three pallet surface components 102, which provide the surfaces to be used as shelves. Two of the pallet surfaces 1102 are supported by four top extension members 1104*a*. Four extension members 1104 attach to the bottom side of a top pallet surface component 1102*a* and to the top side of the middle pallet surface component 1102*b* of the shelving unit 1100. The lower extension members 1104 are attached to the top surface of a bottom pallet surface component 1102*c*.

Figure 12:
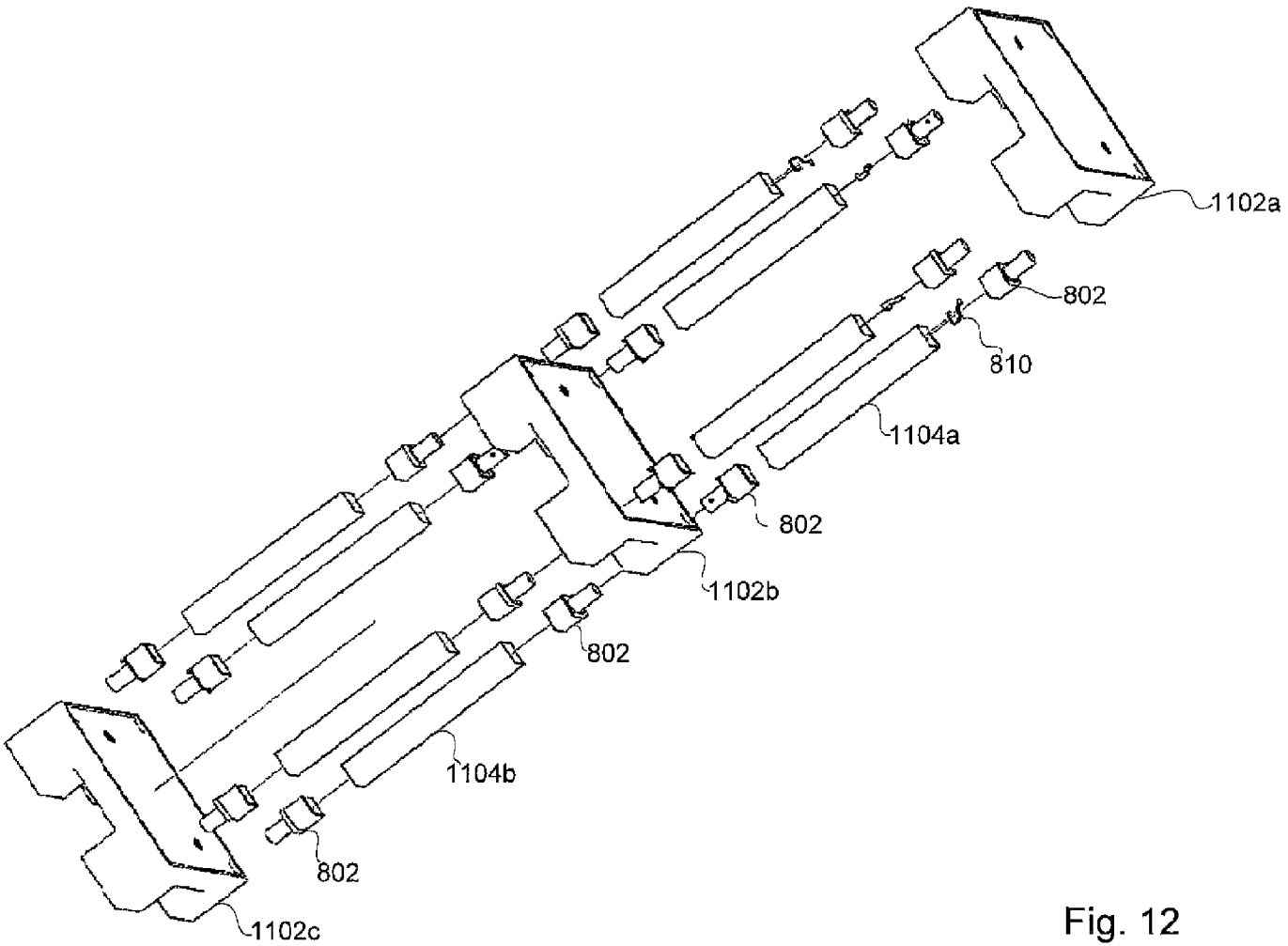
FIG. 12 is an exploded perspective view of the example shelving unit in FIG. 11.

FIG. 12 is an exploded perspective view of the example shelving unit 1100 in FIG. 11. FIG. 11 illustrates how the shelving unit 1100 may be assembled. The four top extension members 1104*a* may be attached to the bottom side of the top shelf pallet surface component 1102*a*. The top extension members 1104*a* may be attached as described above for the coffee table 700 with reference to FIG. 8 using the extended part fasteners 802, and spring clips 810. The extended part fasteners 802 may be turned over to fit over the opposite ends of the top extension members 1104*a*. The cylindrical portion of the extended part fasteners 802 may be press-fit, or fastened with attachment devices such as screws, bolts etc. into corresponding holes 1106 on the top side of the middle shelf pallet surface component 1102*b*.

Similarly, the bottom extension members 1104*b* may be attached to the bottom side of the middle shelf pallet surface component 1102*b* as described above for the coffee table 700 with reference to FIG. 8 using the extended part fasteners 802, and spring clips 810. The extended part fasteners 802 may be turned over to fit over the opposite ends of the bottom extension members 1104*b*. The cylindrical portion of the extended part fasteners 802 may be press-fit, or fastened with attachment devices such as screws, bolts, etc. into corresponding holes 1106 on the top side of the bottom shelf pallet surface component 1102*c*.

Figure 13:
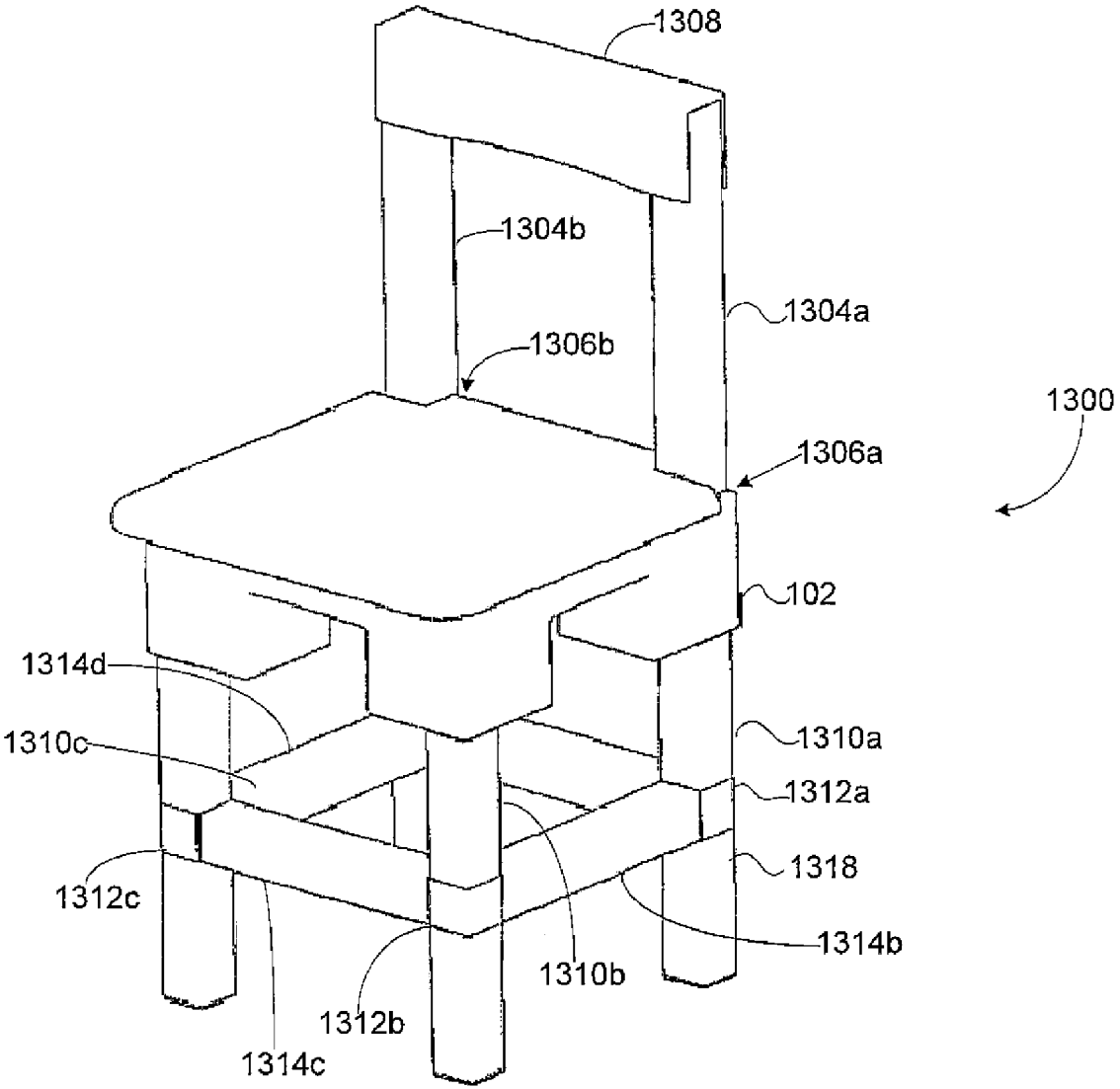
FIG. 13 is a perspective view of an example chair assembled with a pallet surface component in FIG. 5.

FIG. 13 is a perspective view of an example chair 1300 assembled with a pallet surface component 102 in FIG. 5. The pallet surface component 102 is the seat of the chair 1300. The chair 1300 in FIG. 13 includes a seat cover 1302 on the pallet surface component 102. A set of upper extender parts 1304*a,b* extends from two of the a top-side corners 1306*a,b* of the pallet surface component 102. A seat backing 1308 fits over the opposite ends of the upper extender parts 1304*a,b*. Four lower extender parts 1310*a-d* extend from the bottom-side of the pallet surface component 102 to form legs. The opposite ends of the lower extender parts 1310*a-d* connect to cross-member fasteners 1312*a-d*, which connect to corresponding cross-members 1314*a-d*. The cross-member fasteners 1312 also connect to leg extenders 1318*a-d*, which provide footing for contact to the floor.

Figure 14:
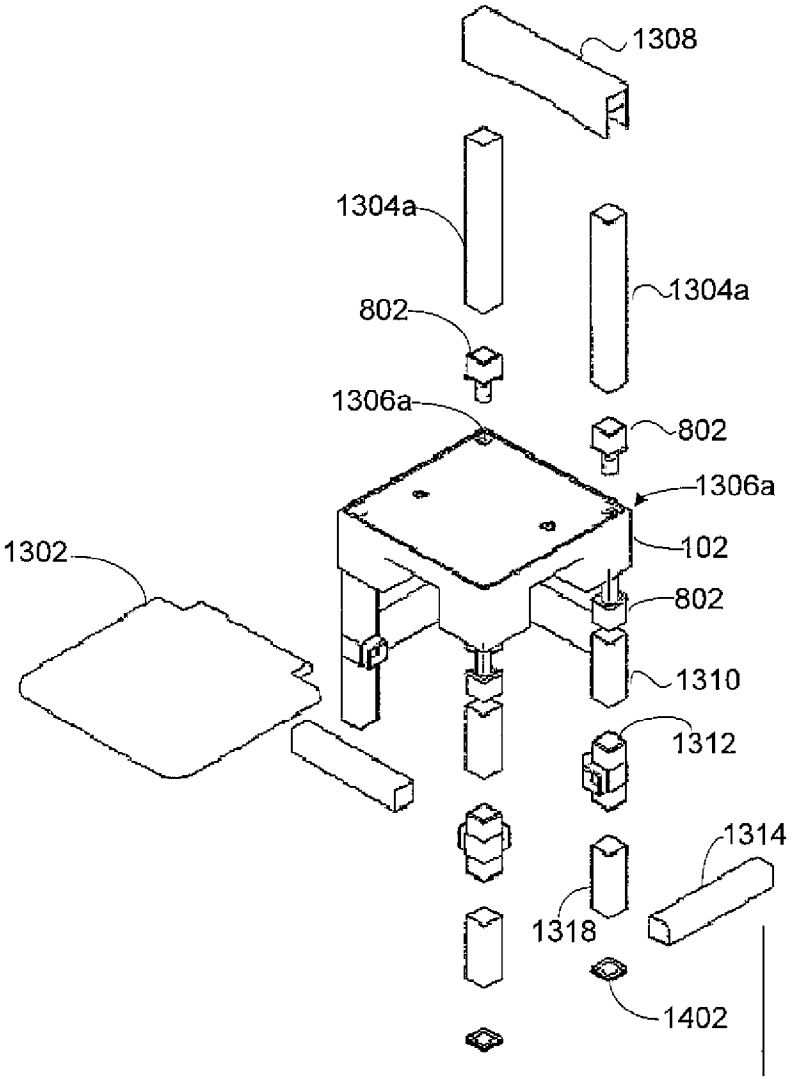
FIG. 14 is an exploded perspective view of the example chair in FIG. 13.

FIG. 14 is an exploded perspective view of the example chair 1300 in FIG. 13. FIG. 14 illustrates how the chair 1300 may be assembled. The pallet surface component 102 is the seat of the chair 1300 and includes the upper extender parts 1304*a,b* attached to the top-side corner 1306 of the pallet surface component 102 via the extended part fastener 802. As described above, the cylindrical part of the extended part fastener 802 may be inserted into a corresponding receiving hole on the pallet surface component 102. The block part of the extended part fastener 802 fits inside the upper extender parts 1304*a*. The seat backing 1308 may be made to slip on to the ends of the upper extender parts 1304*a,b*.

As shown in FIG. 14, the lower extender parts 1310*a-d* may be attached to the corner sections 302 of the pallet surface component 102 as described above for the coffee table 700 with reference to FIG. 8. The lower extender parts 1310*a-d* may attach to cross-member fasteners 1312*a-d*, which may attach to cross-members 1314*a-d*. Leg extenders 1318*a-d* may be connected to the cross-member fasteners 1312*a-d* to provide contact to the floor via floor pads 1402.

The foregoing description of examples and implementations has been presented for purposes of illustration and description. It is not exhaustive and does not limit the claimed inventions to the precise form disclosed. Modifications and variations are possible in light of the above description or may be acquired from practicing the invention. As an example, although the above examples of the present invention have been described in the context of shelving and tables, the teachings of the invention are applicable to an unlimited variety of types of equipment, including cabinets, lockable cabinets, podiums, desks, chairs, shelves, and any type of furniture. The equipment may also be structures that are not furniture, but instead have other functions. The claims and their equivalents define the scope of the invention.

The invention claimed is:

1. A pallet assembly comprising:

a plurality of beam members having opposing sides oriented substantially perpendicular to a surface supporting the pallet assembly;

a plurality of transverse members configured to attach to the beam members;

a pallet support structure formed by attaching at least two of the transverse members to the sides of at least one pair of beam members, the pallet support structure defining areas of intersection where the transverse members and beam members attach; and a plurality of pallet surface components configured to fit over the areas of intersection on the pallet support structure to form a substantially flat surface and, with the pallet support structure, to function as a pallet, where each of the pallet surface components is substantially centered over a corresponding area of intersection, the pallet surface components having a conversion enabling structure to receive selected components that convert at least the pallet surface components to pieces of equipment that do not function as pallets when detached from the pallet support structure.

2. The pallet assembly of claim 1 where:

each transverse member includes an attachment portion on at least one end of the transverse member where the transverse members connect to the beam members by attaching the attachment portions on opposite sides of the beam members.

3. The pallet assembly of claim 1 where the conversion enabling structure includes openings for receiving extending members to enable conversion of the pallet surface components to pieces of equipment that do not function as pallets.

4. The pallet assembly of claim 1 where multiple pallet surface components are combined with at least one pair of beam members and at least two transverse members to form a table top that is larger than one of the pallet surface components.

5. The pallet assembly of claim 1 where each pallet surface component includes:

a substantially rectangular flat top surface bounded by edges;

a side surface extending perpendicular to the top surface at each edge of the top surface;

an opening at each side surface to receive either the beam member or the transverse member when the pallet surface component fits over one of the areas of intersection on the pallet support structure.

6. The pallet assembly of claim 5 including:

a corner section at each corner of the rectangular top surface formed by the openings on the side surfaces, the corner sections having the conversion enabling structure.

7. The pallet assembly of claim 5 each conversion enabling structure is configured to receive an extension member where a plurality of extension members are used as legs.

8. The pallet assembly of claim 1 where the pieces of equipment that do not function as pallets include furniture structures.

9. The pallet assembly of claim 8 where the furniture structures including chairs, tables, and shelving units.

10. The pallet assembly of claim 1 further comprising:

pallet lifting beams attached to the pallet support structure.

11. A method for disassembling a pallet and re-assembling the pallet as a selected piece of equipment, the pallet having a pallet support structure formed by at least two beam members attached to a plurality of transverse members at intersecting areas, the pallet having a plurality of pallet surface components attached to the pallet support structure at the intersecting areas to form a flat surface, the method comprising:

detaching the plurality of pallet surface components from the intersecting areas of the pallet support structure;

detaching the transverse members from the beam members by collapsing the pallet support structure into a structure in which the beam members and transverse members do not form intersecting areas; and attaching extension members to conversion enabling structure on the pallet surface components to assemble the selected piece of equipment.

12. The method of claim 11 where the step of attaching extension members includes:

attaching vertical support extension members to each corner of the pallet surface component to assemble a table-like structure.

13. The method of claim 11 where the pallet surface components have a substantially rectangular shape with corners, the conversion enabling structure is formed in each corner of the pallet surface components, and the step of attaching extension members includes:

forming a table support structure using at least two beam members connected to at least two transverse members;

fitting one of the pallet surface components to each of the intersecting areas formed on the table support structure; and attaching a table leg structure formed using at least four vertical support extension members configured to fit in the conversion enabling structure on the corners of the pallet surface components.

14. The method of claim 11 where the pallet surface components have a shape with corners, and the step of, attaching extension members includes:

attaching vertical support extension, members to a first side and a second side of each corner of a first pallet surface component; and attaching a second pallet surface component to the vertical support extension members on the first side of the first pallet surface component where the first and second pallet surface components function as shelves of a shelving unit.

15. The method of claim 14 further comprising:

attaching a third pallet surface component to the vertical support extension members on the second side of the first pallet surface component to provide a base shelf to the shelving unit.

16. The method of claim 14 further comprising:

attaching additional vertical support extension members to the second pallet surface component; and attaching a third pallet surface component to the attached vertical support extension members.

17. The method of claim 11 where the step of attaching extension members includes:

attaching vertical support extension members to each corner on a first side of the pallet surface component; and attaching a chair-back structure having at least one chair-back vertical support extension member and a seat backing connected to the at least one chair-back vertical support extension member to the pallet surface component on a second side of the pallet surface component opposite the first side of the pallet surface component having the at least one chair-back vertical support extension member.

18. A pallet assembly comprising:

a plurality of beam members;

a plurality of transverse members;

a pallet support structure formed by attaching the plurality of beam members to the plurality of transverse members, the pallet support structure having areas of intersection where the transverse members and beam members attach;

a plurality of pallet surface components configured to fit over and cover the areas of intersection on the pallet support structure to form a substantially flat surface and, with the pallet support structure, to function as a pallet, the plurality of pallet surface components further comprising a conversion enabling structure to receive selected components that convert the pallet surface components to pieces of equipment that do not function as pallets when detached from the pallet support structure.

19. The pallet assembly of claim 18 where:

each transverse member includes an attachment portion on at least one end of the transverse member where the transverse members connect to the beam members by attaching the attachment portions on opposite sides of the beam members.

20. The pallet assembly of claim 18 where the conversion enabling structure includes openings for receiving extending members to enable conversion of the pallet surface components to pieces of equipment that do not function as pallets.

21. The pallet assembly of claim 18 where multiple pallet surface components arc combined with at least one pair of beam members and at least two transverse members to form a table top that is larger than one of the pallet surface components.

22. The pallet assembly of claim 18 where each pallet surface component includes:

a substantially rectangular flat top surface bounded by edges;

a side surface extending perpendicular to the top surface at each edge of the top surface;

an opening at each side surface to receive either the beam member or the transverse member when the pallet surface component fits over one of the areas of intersection on the pallet support structure.

23. The pallet assembly of claim 22 including:

a corner section at each corner of the rectangular top surface formed by the openings on the side surfaces, the corner sections having the conversion enabling structure.

24. The pallet assembly of claim 22 each conversion enabling structure is configured to receive an, extension member where a plurality of extension members are used as legs.

25. The pallet assembly of claim 18 where the pieces of equipment that do not function as pallets include furniture structures.

26. The pallet assembly of claim 25 where the furniture structures including chairs, tables, and shelving units.

* * * * *